US006830033B2

(12) United States Patent
Boerkel

(10) Patent No.: US 6,830,033 B2
(45) Date of Patent: Dec. 14, 2004

(54) METHOD FOR PHASE RECOGNITION IN AN INTERNAL COMBUSTION ENGINE

(75) Inventor: Wolfgang Boerkel, Benningen (DE)

(73) Assignee: Robert Bosch GmbH, Stuttgart (DE)

( * ) Notice: Subject to any disclaimer, the term of this patent is extended or adjusted under 35 U.S.C. 154(b) by 42 days.

(21) Appl. No.: 10/137,089

(22) Filed: May 1, 2002

(65) Prior Publication Data

US 2002/0166540 A1 Nov. 14, 2002

(30) Foreign Application Priority Data

May 8, 2001 (DE) ..... 101 22 247

(51) Int. Cl.[7] ..... F02P 5/00

(52) U.S. Cl. ..... 123/406.47; 123/436; 123/406.59; 123/643

(58) Field of Search ..... 123/406.47, 406.59, 123/436, 643, 406.24, 406.26, 406.27

(56) References Cited

U.S. PATENT DOCUMENTS

| | | | | |
|---|---|---|---|---|
| 4,616,617 A | * | 10/1986 | Geiger et al. | 123/436 |
| 5,425,340 A | | 6/1995 | Petitbon et al. | |
| 5,503,008 A | * | 4/1996 | Machida | 73/117.3 |
| 5,613,473 A | * | 3/1997 | Angermaier | 123/481 |
| 5,823,166 A | * | 10/1998 | Entenmann et al. | 123/406.58 |
| 6,244,248 B1 | * | 6/2001 | Halleron et al. | 123/339.12 |
| 6,536,410 B1 | * | 3/2003 | Nehse | 123/406.24 |

FOREIGN PATENT DOCUMENTS

| | | |
|---|---|---|
| DE | 35 11 432 A1 | 10/1985 |
| DE | 41 22 786 A1 | 1/1992 |
| DE | 41 38 765 A1 | 7/1992 |
| DE | 42 30 616 A1 | 3/1994 |
| DE | 44 18 577 A1 | 11/1995 |
| DE | 198 14 732 A1 | 10/1999 |
| DE | 198 44 910 A1 | 4/2000 |
| DE | 198 44 910 | 4/2000 |
| EP | 0 640 762 A1 | 3/1995 |
| EP | 0 990 787 A2 | 4/2000 |

* cited by examiner

*Primary Examiner*—Mahmoud Gimie
*Assistant Examiner*—Arnold Castro
(74) *Attorney, Agent, or Firm*—Michael J. Striker

(57) ABSTRACT

A method for phase recognition of an internal combustion engine with a plurality of cylinders is preformed in an operating region of the engine having selected operating conditions. A crankshaft sensor serves to determine the angular position of the crankshaft. A control apparatus evaluates the signals of the crankshaft sensor and triggers injection and ignition impulses depending on the angular position of the crankshaft. The method includes the steps of adopting a phase relationship; changing a λ-value for at least one of the cylinders; injecting at a selected time once or twice per working cycle in each cylinder; detecting speed changes of the internal combustion engine through at least one working cycle; and distinguishing whether the phase relationship of step B is correct or incorrect by the point in time of a rotational speed change or by an absence of rotational speed changes.

13 Claims, 2 Drawing Sheets

METHOD FOR PHASE RECOGNITION IN AN INTERNAL COMBUSTION ENGINE

BACKGROUND OF THE INVENTION

In a multi-cylinder internal combustion engine with a crankshaft and a camshaft, the phase relationship of the internal combustion engine is calculated by a control apparatus in dependence on the angular position of the crankshaft or the camshaft. From this, it is provided at what point in time and into which cylinder fuel is injected and when the ignition must be tripped. The angular position of the crankshaft, for example, can be ascertained by means of a crankshaft sensor, which senses the crankshaft, or a disk connected with the crankshaft, with a characteristic surface. The surface can contain, for example, similar marks and a reference mark. The phase relationship of the internal combustion engine is not determinable only through ascertaining the crankshaft angular position, however, since the crankshaft rotates in a four-stroke cycle twice within a working cycle. The phase relationship arises typically with the assistance of a camshaft sensor, which senses a sensing disk connected to the camshaft, the disk having a reference mark. The camshaft rotates only once during the working cycle. Therefore, the control apparatus can recognized the phase relationship of the internal combustion engine from the signal of the camshaft sensor. The control apparatus consequently can perform a synchronization, that is, a clear assignment of fuel injection times and ignition times to the individual cylinders. In the event the camshaft sensor is out of commission or is not provided, the phase relationship must be determined in another manner.

DE 42 30 616 A1 relates to a device for determining the position of a shaft of an internal combustion engine, in which a sensor disk with a reference mark, connected to the shaft, is detected by a sensor, and the output signals are evaluated in a control apparatus. Therefore, immediately after starting-up the internal combustion engine, the position of the shaft is known, the determined position after switching off the internal combustion engine and after running the shaft is input in a memory of the control apparatus, and is used after again turning on the internal combustion engine for determining and input of the first injection during a start phase.

DE 44 18 577 discloses a device for regulating an internal combustion engine. The position of the crankshaft is continuously determined with the assistance of a corresponding sensor from a control apparatus. A phase sensor is not necessary. Instead, the beginning of the injection related to the angular positioning of the crankshaft for an individual cylinder is changed, so that from one working cycle to the next, a rotational change is initiated upon an incorrect phase relationship. These rotational changes are recognized with the help of the evaluation of the signals of the crankshaft sensor and is calculated in the control apparatus, where they are used for phase recognition and subsequently, for phase synchronization.

EP 0 640 762 A1 relates to an electronic engine-control apparatus for an internal combustion engine, which, without a camshaft sensor, performs the synchronization, that is, the specific assignment of fuel injection and ignition to the individual cylinders. Thus, the ignition and fuel injection of the internal combustion engine are operated in groups from starting until achievement of a stabile operating condition. After reaching the stabile operating state, either the ignition or the fuel injection for a selected cylinder takes place. A possible combustion misfire is detected and all cylinders can be correspondingly synchronized.

U.S. Pat. No. 5,425,340 discloses a method that determines the state of the cylinder of an internal combustion engine in its operating cycle. A crankshaft sensor runs a first signal when the upper firing top center is reached in a cylinder. A system for recognizing combustion misfires produces a second signal in the event of a misfire in the cylinders. The method includes many sequential method steps: the fuel injection for a determined reference cylinder is stopped. Combustion misfires in this cylinder are detected. From the time difference between the time of stopping the fuel injection and the occurrence of the combustion misfire, the time of the ignition or top dead center (TDC) of the reference cylinder is provided.

DE 198 44 910 relates to another device for phase recognition of an internal combustion engine, in which only a crankshaft sensor is provided. The phase signal is acquired through suppression of injection for a selected cylinder and simultaneous rotational speed analysis. If the expected rotational speed process is adjusted with several suppressed injections for the same cylinder, it can be concluded that the synchronization is correct. If these parameters are not fulfilled, the synchronization incorrect at 360° crankshaft angle and an un-synchronization takes place.

In the state of the art, a number of methods and devices for recognizing combustion misfires are known.

DE 198 14 732 A1 relates to a method for determining rotational speed, in particular combustion misfire recognition.

DE 41 38 765 A1 concerns a method and a device for determining a process instability value of an internal combustion engine on the basis of time, in which the crankshaft strokes over determined dial sectors (time segments).

SUMMARY OF THE INVENTION

The method for phase recognition in an internal combustion engine of the present invention has the advantage that a synchronization can take place without a camshaft sensor, especially, when the sensor is not working. Thus, a breakdown of the car driven by the internal combustion engine is avoided upon a defect of the camshaft sensor. In addition, the method of the present invention produces a substantially smaller loss of ease or comfort than the processes for phase recognition in the state of the art, for example, which includes an injection suppression, since combustion misfires are prevented. In addition, the invention method is useable with both odd and even numbers of cylinders. By repeating the method steps several times, the correct phase relationship can be accurately recognized.

These advantages are achieved through a process for phase recognition in an internal combustion engine with a number of cylinders in a suitable operating area, whereby a crankshaft sensor serves to determine the angular position of the crankshaft, a control apparatus calculates the signals of the crankshaft sensor, and the control apparatus in dependence on the angular position of the crankshaft triggers an injection or ignition impulse. The inventive method includes the following steps:

A) Setting two ignition points for each cylinder, respectively, near the top dead center (TDC) of the applicable piston;

B) Adoption of a phase relationship;

C) Changing the λ-value for at least one cylinder;

D) Injecting at the selected point in time once or several times per working cycle in each cylinder;

E) Detecting rotational speed changes of the internal combustion engine by means of at least one working cycle; and F) Distinguishing with the aid of the time point of the rotational speed changes or by the absence of rotational speed changes whether the phase relationship adopted in Step B is correct or incorrect.

Method step A means that a doubled ignition output takes place. The ignition is triggered in each cylinder near the two top dead center (TDC)s of the applicable piston. A working cycle of a four-stroke internal combustion engine includes four strokes. These are compression, expansion, exhaust, and suction strokes. During operation of these four strokes, the piston reaches the top dead center (TDC) twice within a working cycle. In the ignition TDC, which lies between the compression and expansion strokes, the ignition is triggered during normal operation of the internal combustion engine. In the second TDC (gas changing or load changing TDC), which lies between the exhaust and suction strokes, no ignition is triggered in normal operation of the internal combustion engine. The ignition in both TDC's is performed, then, when the phase in which the respective cylinder is found is not known, rather only the time points at which the applicable pistons reach the two TDC's. This is the case, for example, when, with the assistance of the crankshaft sensor, the angular postioning of the crankshaft is known, however, not specifically in which working cycle of the respective cylinder it is found, particularly when the camshaft sensor is not working. By means of the double ignition output, it is provided that the ignition in each case at the ignition TDC take place, also when it is at the gas changing TDC.

In method step B, a phase relationship is assumed as correct. The angular position of the crankshaft, determined by means of the crankshaft sensor, serves as basic knowledge for this assumed phase relationship. This angular position can lead to two possible phase relationships, since the crankshaft rotates twice within a working cycle in a four-stroke cycle (720° crankshaft angle). One of these two possible phase relationships is assumed as correct in step B. This accepted phrase relationship can be correct or inverted about a 360° crankshaft angle.

In step C, the λ-value for at least one cylinder is changed. The λ-value is the so-called air factor or coefficient. The complete combustion of the fuel requires an air requirement of approximately 14.7 kilograms of air for each kilogram of fuel. The air factor A was defined by characterizing the mixture strength. It is the ratio of the actual air-fuel ration to the stoichiometric air-fuel ratio. For Otto carburetor engines, the regulating concept exists to operate the engine in a very limited region at $\lambda=1$ with the goal of a higher effectiveness of exhaust reduction. This concept requires a precise regulation of the mixture with a λ-probe as a sensor in front of the catalyzer. An air value of $\lambda \geqq 1$ indicates that the air-fuel mixture to be burned is becoming lean. In the inventive method, the λ-value in at least one cylinder is changed, that is, the air factor, compared to its value in normal operation of the internal combustion engine, is increased or reduced.

The injection takes place in the inventive method at selected points in time once or twice per working cycle in each cylinder. Therefore, the chosen time point is insignificant, because in internal combustion engine, which are not direct injectors, the inlet valve of each cylinder is opened at the correct time. Thus, no fuel-air mixture can be injected mistakenly, for example, during the discharge stroke in the cylinder. In at least one cylinder, in step D, a fuel-air mixture having a λ-value that was changed in step C is injected. The air factors λ of the air-fuel mixtures in the remaining cylinders should remain the same and differ from the changed λ-value. The λ-value determined for all of the cylinders can be set based on one, in order to allow the catalyzer to operate most effectively.

By means of the λ-value changed in at least one cylinder, characteristic changes of the rotational speed process of the internal combustion engine occur in contrast with normal operation with an unchanged air factor λ. By a lean mixture of one cylinder ($\lambda \geqq 1$), a break in the rotational speed, for example, takes place after the ignition time for this mixture, since less energy is converted, or the lean cylinder provides a smaller moment than when running regularly. This speed fluctuations are detected in step E. The detection can take place, for example, with the help of the crankshaft sensor. Therefore, the time is measured in which the crankshaft strikes over one or more determined segments. From the segment times, the actual speed is provided.

By using the time point of the occurrence of the detective speed change or by the absence of sped changes, it can be distinguished whether the phase relationship adopted in step B is correct or incorrect. The adopted phase relationship is correct when the speed change in the segment after the ignition FCT of the respective cylinder occurs, in which a mixture with a changed λ-value was injected. The assumed phase relationship is incorrect if the speed change does not occur as expected in this segment, occurs in no determined segment, or is completely absent. To distinguish the "lean" or "fat" combustion from normal combustion, a threshold value is determined, which must fall below or exceed the actual speed, with which a relevant speed change is registered. In the event the adopted phase relationship is incorrect and no speed change occurs in the segment, which according to the assumed phase relationship should lie after the ignition TDC, also an evaluation of the cylinder at a 360° crankshaft angle is possible with an even number of cylinders. With four-cylinder, four-stroke engines, the ignition sequence of the individual cylinder is determined, for example, on I-II-IV-II. The fourth cylinder is offset to the first, second, and third cylinders at 360°. Thus, it follows that at the point in time at which, for example, the piston of the first cylinder at the gas change-TDC, the piston of the fourth cylinder is at the ignition-TDC and reversed. If, the, with the inventive method the incorrect phase relationship was assumed for the first cylinder, and thus, no speed change in the segment after the expected ignition TDC was detected, one can adopt the original phase relationship for the first cylinder for the fourth cylinder displaced at 360° and with this, perform the inventive method anew.

The method of the present invention for phase recognition in an internal combustion engine should be performed only in a suitable operating area of the internal combustion engine. A suitable operating area, in this connection, is one in which the least possible or no speed fluctuations occur that are not caused by the method of the present invention and that would provide incorrect results for the phase recognition. Conditions for a suitable operating area are, for example, constant load, constant rotational speed, and constant temperature of the internal combustion engine. Also advantageous is the operational readiness of the λ-probe for regulating and holding constant the air factor λ in the remaining cylinders, whose λ-value should not be changed based on the inventive method. In the event the operating state is not stabile during performance of the inventive method, the detection can be interrupted and the process can be started anew at a later time with suitable operating conditions.

DETAILED DESCRIPTION OF THE PREFERRED EMBODIMENTS

Figure 1:
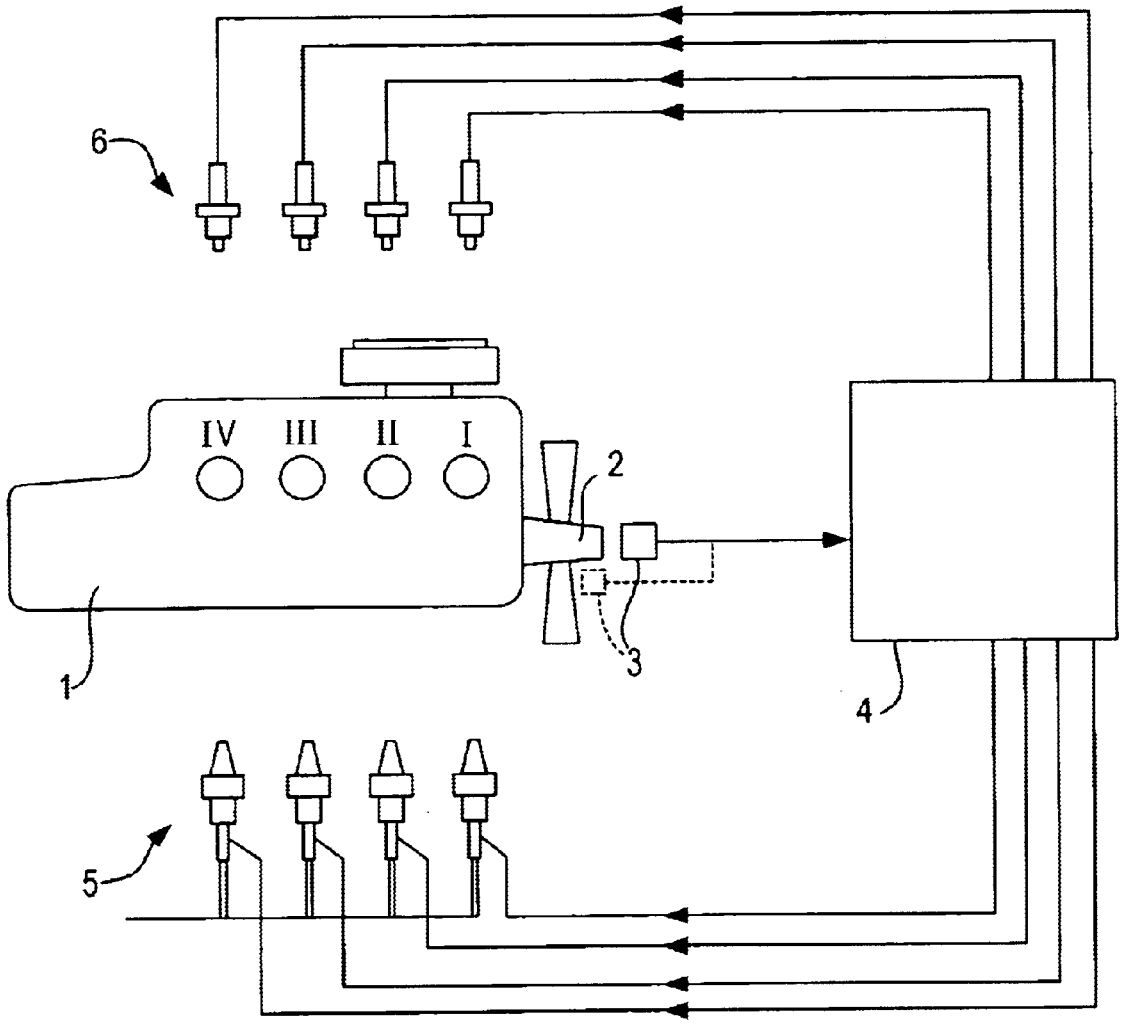
FIG. 1 is a view schematically illustrating a method for phase recognition in an internal combustion engine, in accordance with the present invention.
Figure 2:
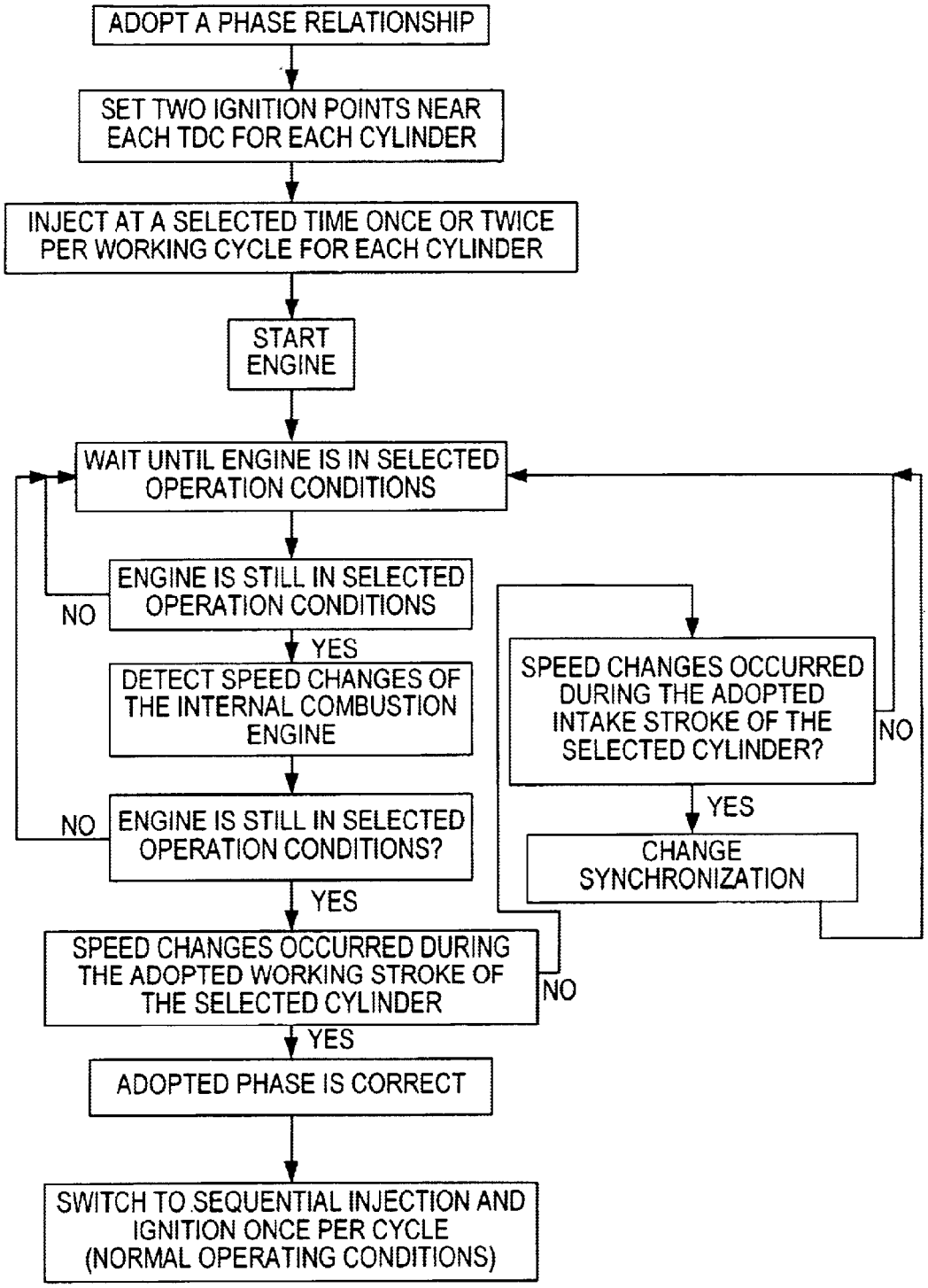
FIG. 2 is a flow chart illustrating the steps of the inventive method.

FIG. 1 shows an internal combustion engine 1 having a plurality of cylinders and a crankshaft 2. A crankshaft sensor 3 is associated with the crankshaft 2 to determine an angular position of the crankshaft. A control apparatus identified with reference numeral 4 receives signals from the crankshaft sensor 3 and triggers injection impulses for operating fuel injection valves 5 and ignition impulses for operating spark plug 6.

In a preferred embodiment of the present invention, the crankshaft sensor determines the angular position of the crankshaft, in which the sensor senses a disk having a characteristic surface and that is connected to the crankshaft. On the surface of the disk, for example, a reference mark can be applied, whereby a plurality of similar markings are applied additionally to the crankshaft disk in a similar manner. The reference mark can be realized, for example, by means of two missing markings. In particular, the reference mark can indicate the obtainment of the top dead center of a selected piston.

In another embodiment of the method of the present invention, in step C, the λ-value of at least one cylinder is changed so that the mixture of the cylinder is made leaner. The air factor, then, is changed to a larger value. The process of rending the mixture lean, therefore, can be so selected that the leanness of the mixture is optimal for recognition of the phase relationship, that the exhaust of the internal combustion engine is minimally harmful and acceptable for driving comfort. The leanness is optimal for the recognition of the phase relationship when it generates a sufficiently large speed change of the internal combustion engine for the accurate detection and subsequent evaluation. The leanness is acceptable for driving comfort and the effectiveness of contaminant reduction when combustion misfires are avoided.

In a further embodiment of the present invention, the λ-value of at least one cylinder is changed such that a fattening of the mixture of the cylinder takes place. The air factor λ is thus changed to a smaller value.

It is also contemplated that a change of the λ-value for several neighboring cylinders in an ignition series take place. Then, many consecutive increases or breaks in speed would be expected.

In another embodiment of the method of the present invention, the sum of the λ-values of all of the cylinders remains unchanged during the change of the λ-value. This means, for example, that with a leaner or fatter mixture of a cylinder, all of the other cylinders are made leaner or fatter for phase recognition, so that the λ-value averages 1. It is advantageous that the internal combustion engine emits a nearly optimal exhaust. The sum λ-regulation could remain in operatin during the method.

Preferably, the detection of speed fluctuations of the internal combustion engine takes place in the inventive method by means of a crankshaft sensor.

In another embodiment of the inventive method, the internal combustion engine runs further in normal operation after distinguishing that the phase relationship adopted in step B is correct. Normal operation means, generally, that the double ignition output is canceled and only one ignition, respectively, at the ignition TDC is triggered. In addition, all limitations can be lifted, which during the performance of the inventive method were applied.

Preferably, in addition, after the determination that the phase relationship adopted in step B is incorrect, an un-synchronization occurs. Un-synchronization means in this connection a new assignment of fuel injection and ignition times to the individual cylinders. Known engine control apparatus are typically equipped with microprocessor, which serve to handle the complex calculation and control operations. Thus, the changes or completion for the performance of an un-synchronization are essentially achievable through changes and completion of the microprocessor programs. Preferably, after the un-synchronization, the process steps A through F are performed again for checking the phase relationship adopted after the un-synchronization.

Preferably, the method of the present invention is repeated to the point at which the phase relationship of the internal combustion engine can be recognized. The repeated performance of the method can take place always at the same cylinder.

It is likewise also contemplated that the new or repeated performance of the method steps A through F takes place at at least one other cylinder. This applies for new performance of the steps after an un-synchronization as well as for repeating performance for an accurate recognition of the phase relationship.

It will be understood that each of the elements described above, or two or more together, may also find a useful application in other types of constructions differing from the types described above.

While the invention has been illustrated and described herein as a method for phase recognition in an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. Method for phase recognition in an internal combustion engine with a plurality of cylinders in a suitable operating region, whereby a crankshaft sensor serves to determine a angular position of the crankshaft, a control apparatus evaluates the signals of the crankshaft sensor, and the control apparatus triggers injection and ignition impulses in dependence on the angular position of the crankshaft, the method comprising the following steps:

A) Setting two ignition points for each working cycle for each cylinder, respectively, near a top dead center of a corresponding position;

B) Adopting a phase relationship;

C) Changing a λ-value for at least one of the cylinders;

D) Injecting at a selected time once or twice per working cycle in each cylinder E) Detecting speed changes of the internal combustion engine through at least one working cycle; and F) Distinguishing whether the phase relationship of step B is correct or incorrect by when a speed change occurred or by an absence of speed changes.

2. Method as defined in claim 1, wherein the crankshaft sensor determines the angular position of the crankshaft by sensing characteristics in a surface of a disk connected to the crankshaft.

3. Method for phase recognition in an internal combustion engine with a plurality of cylinders in a suitable operating region, whereby a crankshaft sensor serves to determine a angular position of the crankshaft, a control apparatus evaluates the signals of the crankshaft sensor, and the control apparatus triggers injection and ignition impulses in dependence on the angular position of the crankshaft, the method comprising the following steps;

A) Setting two ignition points for each workings cycle for each cylinder, respectively, near a top dead center of a corresponding position;

B) Adopting a phase relationship;

C) Changing a λ-value for at least one of the cylinders;

D) Injecting at a selected time once or twice our working cycle in each cylinder;

E) Detecting speed changes of the internal combustion engine through at least one working cycle; and F) Distinguishing whether the phase relationship of Step B is correct or incorrect by when a speed change occurred or by an absence of speed changes, wherein the λ-value of at least one of the cylinders is changed to a value such that a mixture of the at least one cylinder becomes leaner.

4. Method as defined in claim 1, wherein the λ-value of at least one of the cylinders is change to a value such that a mixture of the at least one cylinder becomes richer.

5. Method for phase recognition in an internal combustion engine with a plurality of cylinders in a suitable operating region, whereby a crankshaft sensor serves to determine a angular position of the crankshaft, a control apparatus evaluates the signals of the crankshaft sensor, and the control apparatus triggers injection and ignition impulses in dependence on the angular position of the crankshaft, the method comprising the following steps;

A) Setting two ignition points for each working cycle for each cylinder, respectively, near a top dead center of a corresponding position;

B) Adopting a phase relationship;

C) Changing a λ-value for at least one of the cylinders;

D) Injecting at a selected time once or twice per working cycle in each cylinder;

E) Detecting speed changes of the internal combustion engine through at least one working cycle; and F) Distinguishing whether the phase relationship of step B is correct or incorrect by when a speed change occurred or by an absence of speed changes, wherein a change of the λ-value for several neighboring cylinders in an ignition sequence takes place.

6. Method for phase recognition in an internal combustion engine with a plurality of cylinders in a suitable operating region, whereby a crankshaft sensor serves to determine a angular position of the crankshaft, a control apparatus evaluates the signals of the crankshaft sensor, and the control apparatus triggers injection and ignition impulses in dependence on the angular position of the crankshaft, the method comprising the following steps;

A) Setting two ignition points for each working cycle for each cylinder, respectively, near a top dead center of a corresponding position;

B) Adopting a phase relationship;

C) Changing a λ-value for at least one of the cylinders;

D) Injecting at a selected time once or twice per working cycle in each cylinder;

E) Detecting speed changes of the internal combustion engine through at least one working cycle; and F) Distinguishing whether the phase relationship of step B is correct or incorrect by when a speed change occurred or by an absence of speed changes, wherein during the change of the λ-value, a sum of λ-values for all the cylinders remains unchanged.

7. Method as defined in claim 1, wherein the detection of speed changes of the internal combustion engine takes place with assistance of the crankshaft sensor.

8. Method for phase recognition in an internal combustion engine with a plurality of cylinders in a suitable operating region, whereby a crankshaft sensor serves to determine a angular position of the crankshaft, a control apparatus evaluates the signals of the crankshaft sensor, and the control apparatus triggers injection and ignition impulses in dependence on the angular position of the crankshaft, the method comprising the following steps;

A) Setting two ignition points for each working cycle for each cylinder, respectively, near a top dead center of a corresponding position;

B) Adopting a phase relationship;

C) Changing a λ-value for at least one of the cylinders;

D) Injecting at a selected time once or twice per working cycle in each cylinder;

E) Detecting speed changes of the internal combustion engine through at least one working cycle; and F) Distinguishing whether the phase relationship of step B is correct or incorrect by when a speed change occurred or by an absence of speed changes, wherein steps A–F are interrupted when an operating area of the internal combustion engine does not exhibit selected operating conditions.

9. Method as defined in claim 1, wherein the internal combustion engine is run further in a normal operation if the adopted phase relationship of step B is correct.

10. Method as defined in claim 1, wherein an un-synchronization is performed if the adopted phase relationship of step B is incorrect.

11. Method as defined in claim 10, wherein steps A–F are performed a new to evaluate a phase relationship adopted after the un-synchronization.

12. Method as defined in claim 1, wherein steps A–F are repeated until the phase relationship of the internal combustion engine is accurately recognized.

13. Method as defined in claim 11, wherein said repetition of steps A–F is performed on another cylinder.

* * * * *